US011037487B2

(12) United States Patent
Pyun et al.

(10) Patent No.: US 11,037,487 B2
(45) Date of Patent: Jun. 15, 2021

(54) DISPLAY DEVICE AND DRIVING METHOD THEREOF

(71) Applicant: Samsung Display Co., Ltd., Yongin-si (KR)

(72) Inventors: Ki Hyun Pyun, Yongin-si (KR); Su Min Yang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/905,237

(22) Filed: Jun. 18, 2020

(65) Prior Publication Data

US 2021/0012705 A1 Jan. 14, 2021

(30) Foreign Application Priority Data

Jul. 10, 2019 (KR) ..... 10-2019-0083296

(51) Int. Cl.
*G09G 3/32* (2016.01)

(52) U.S. Cl.
CPC ..... *G09G 3/32* (2013.01); *G09G 2310/027* (2013.01); *G09G 2320/0673* (2013.01); *G09G 2330/028* (2013.01)

(58) Field of Classification Search
CPC ..... G09G 3/32; G09G 2330/028; G09G 2310/027; G09G 2320/0673
See application file for complete search history.

(56) References Cited

U.S. PATENT DOCUMENTS

| | | | | |
|---|---|---|---|---|
| 7,123,223 | B2 | 10/2006 | Moon | |
| 8,976,206 | B2 | 3/2015 | Kim et al. | |
| 2009/0160880 | A1* | 6/2009 | Park | G09G 3/3233 345/690 |
| 2011/0273425 | A1* | 11/2011 | Kojima | G09G 3/3291 345/211 |
| 2012/0023975 | A1* | 2/2012 | Yoon | F25D 11/022 62/81 |
| 2017/0076695 | A1 | 3/2017 | Hwang et al. | |

FOREIGN PATENT DOCUMENTS

| | | | |
|---|---|---|---|
| KR | 10-1354427 | B1 | 1/2014 |
| KR | 10-1503064 | B1 | 3/2015 |
| KR | 10-2017-0031322 | A | 3/2017 |

* cited by examiner

*Primary Examiner* — Andrew Sasinowski
(74) *Attorney, Agent, or Firm* — Lewis Roca Rothgerber Christie LLP

(57) ABSTRACT

A display device includes: a display panel including a plurality of pixels; a power supply configured to generate a gamma power voltage based on a power control signal; a gamma voltage generator configured to generate gamma voltages based on the gamma power voltage and a gamma control signal; a data driver configured to generate a data signal corresponding to a grayscale value included in image data using the gamma voltages and to provide the data signal to the pixels; and a power controller configured to adjust the power control signal and the gamma control signal based on a maximum voltage level of the data signal, wherein a voltage level of the gamma power voltage is proportional to the maximum voltage level of the data signal.

15 Claims, 8 Drawing Sheets

DISPLAY DEVICE AND DRIVING METHOD THEREOF

CROSS-REFERENCE TO RELATED APPLICATION

The present application claims priority to and the benefit of Korean Patent Application No. 10-2019-0083296 filed in the Korean Intellectual Property Office on Jul. 10, 2019, the entire content of which is incorporated herein by reference.

BACKGROUND

1. Field

Aspects of some example embodiments of the present invention relate to a display device and a driving method thereof.

2. Description of the Related Art

A display device includes a display panel and a driver. The display panel includes scan lines, data lines, and pixels. The driver includes a scan driver that may sequentially provide scan signals to the scan lines and a data driver that provides data signals to the data lines. Each of the pixels may emit light with brightness corresponding to the data signal provided through a corresponding data line in response to the scan signal provided through a corresponding scan line.

The data driver may divide a power voltage provided from an external source to generate gamma voltages corresponding to a plurality of grayscales, and may convert a grayscale value of image data into a data signal by using the gamma voltages.

The above information disclosed in this Background section is only for enhancement of understanding of the background and therefore the information discussed in this Background section does not necessarily constitute prior art.

SUMMARY

As time passes, the pixel (or a transistor and a light emitting element in the pixel) may become degraded, and a voltage level of the data signal for the pixel to emit light with the same brightness may be changed. To prevent or reduce such degradation, a voltage range of the gamma voltages may include a compensation margin for a degradation compensation of the pixel, and the power voltage used for generating the gamma voltages may also be set relatively high in consideration of the compensation margin.

However, as a voltage level of a power voltage increases, power consumption of the display device may increase.

Some example embodiments of the present invention include a display device that can reduce power consumption and a driving method thereof.

A display device according to some example embodiments of the present invention includes a display panel including pixels; a power supply configured to generate a gamma power voltage based on a power control signal; a gamma voltage generator configured to generate gamma voltages based on the gamma power voltage and a gamma control signal; a data driver configured to generate a data signal corresponding to a grayscale value included in image data using the gamma voltages and to provide the data signal to the pixels; and a power controller configured to adjust the power control signal and the gamma control signal based on a maximum voltage level of the data signal. Here, a voltage level of the gamma power voltage is proportional to the maximum voltage level of the data signal.

According to some example embodiments of the present invention, the display device may further include a storage configured to store a first setting value for the power control signal, second setting values for the gamma control signal, and a lookup table. Here, the first setting value represents the voltage level of the gamma power voltage.

According to some example embodiments of the present invention, the second setting values may represent a relative position of the gamma voltages with respect to the voltage level of the gamma power voltage, the lookup table may include a selection value for gray voltages corresponding to the grayscale value among gray voltages, and the gray voltages may be generated by dividing the gamma voltages.

According to some example embodiments of the present invention, the power controller may include a storage block that loads the first setting value of the power control signal, the second setting values of the gamma control signal, and the lookup table from the storage; and a power control block that calculates the maximum voltage level of the data signal based on the first setting value, the second setting values and the lookup table, calculates a target voltage level of the gamma power voltage based on the maximum voltage level of the data signal and a margin setting value, and updates the first setting value of the power control signal and the second setting values of the gamma control signal based on the target voltage level, respectively.

According to some example embodiments of the present invention, the power controller may calculate an expected voltage level of the gamma power voltage based on the first setting value, calculate a first gamma voltage based on a first gamma setting value among the expected voltage level of the gamma power voltage and the second setting values, and calculate a maximum voltage level of the data signal based on the first gamma voltage and the lookup table, and the first gamma voltage may have a largest voltage level of the gamma voltages.

According to some example embodiments of the present invention, the first gamma voltage may have a voltage level that is greater than the maximum voltage level of the data signal by the margin setting value, and the margin setting value may be about 10% to 15% of the maximum voltage level of the data signal.

According to some example embodiments of the present invention, the voltage level of the gamma power voltage may be greater than the voltage level of the first gamma voltage by the margin setting value.

According to some example embodiments of the present invention, the selection value of the lookup table may be variable.

According to some example embodiments of the present invention, the maximum voltage level of the data signal may correspond to a maximum grayscale value when a load of the image data is less than or equal to a reference load, and may be greater than a voltage level corresponding to the maximum grayscale value when the load of the image data is greater than the reference load.

According to some example embodiments of the present invention, the pixels may include a first pixel that emits light with a first color, a second pixel that emits light with a second color, and a third pixel that emits light with a third color, and the maximum voltage level of the data signal may correspond to the first pixel.

According to some example embodiments of the present invention, the margin setting value may increase as a driving time of the display panel increases.

A driving method of a display device according to some example embodiments of the present invention may be performed in the display device that generates gamma voltages based on a gamma power voltage and a gamma control signal, generates a data signal corresponding to a grayscale value included in image data using the gamma voltages, and provides the data signal to pixels. The driving method includes extracting a maximum voltage level of the data signal; determining a target voltage level of the gamma power voltage based on the maximum voltage level; and adjusting at least one of the gamma voltages by changing the gamma control signal based on the target voltage level of the gamma power voltage. Here, the target voltage level of the gamma power voltage is proportional to the maximum voltage level of the data signal.

According to some example embodiments of the present invention, the driving method may further include storing the target voltage level of the gamma power voltage and the changed gamma control signal in storage.

According to some example embodiments of the present invention, a target voltage level of the gamma power voltage may be determined based on the maximum voltage level of the data signal and a margin setting value.

According to some example embodiments of the present invention, extracting the maximum voltage level of the data signal may include calculating a first gamma voltage having a largest voltage level among the gamma voltages based on the gamma power voltage and a first gamma setting value; and calculating the maximum voltage level of the data signal based on the first gamma voltage and a predetermined lookup table. Here, the first gamma setting value represents a relative position of the first gamma voltage with respect to the voltage level of the gamma power voltage, the lookup table includes a selection value for a gray voltage corresponding to the grayscale value among gray voltages, the gray voltages are generated by dividing the gamma voltages, and the target voltage level of the gamma power voltage is calculated by summing the maximum voltage level of the data signal and a margin setting value.

According to some example embodiments of the present invention, the maximum voltage level of the data signal may correspond to a maximum grayscale value when a load of the image data is less than or equal to a reference load, and may be greater than a voltage level corresponding to the maximum grayscale value when the load of the image data is greater than the reference load.

The display device according to some example embodiments of the present invention and the driving method thereof may reduce power consumption by setting an optimal gamma power voltage based on the maximum voltage level of the data signal and changing the gamma control signal for gamma voltages according to the gamma power voltage.

DETAILED DESCRIPTION

Figure 1:
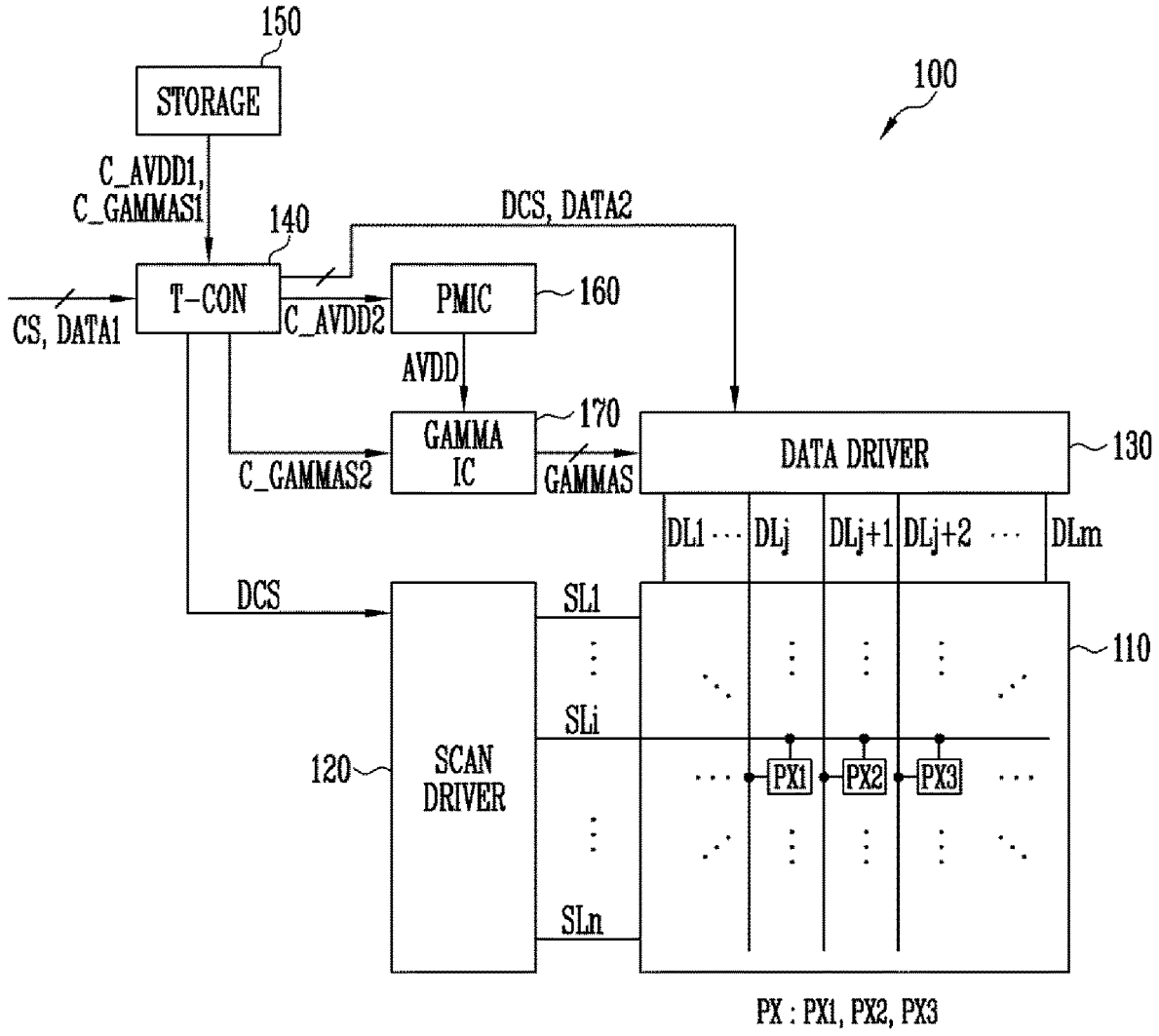
FIG. 1 is a block diagram showing a display device according to some example embodiments of the present invention.

Hereinafter, with reference to accompanying drawings, aspects of various example embodiments of the present invention will be described in more detail so that those skilled in the art can easily carry out the present invention. The present invention may be embodied in many different forms and is not limited to the example embodiments described herein.

In order to more clearly illustrate the present invention, parts that are not helpful for understanding the description may be omitted, and the same or similar constituent elements are given the same reference numerals throughout the specification. Therefore, the above-mentioned reference numerals can be used in other drawings.

In addition, because the size and thickness of each configuration shown in the drawing may be arbitrarily shown for better understanding and ease of description, embodiments according to the present invention are not necessarily limited to the illustrated one. In the drawings, the dimensions of layers and regions may be exaggerated for clarity of illustration.

FIG. 1 is a block diagram showing a display device according to some example embodiments of the present invention.

Referring to FIG. 1, a display device 100 may include a display unit 110 (or display panel), a scan driver 120 (or gate driver), a data driver 130 (or source driver), a timing controller 140, a storage 150 (or storage device or memory device), a power supply unit 160 (or PMIC), and a gamma voltage generator 170.

The display unit 110 may include scan lines SL1 to SLn (where n is a positive integer) (or gate lines), data lines DL1 to DLm (where m is a positive integer), and a pixel PX. The pixel PX may be disposed in an area (e.g., pixel area) partitioned by the scan lines SL1 to SLn and the data lines DL1 to DLm.

The pixel PX may include pixels PX1, PX2, and PX3 that emit light with different colors. For example, the first pixel PX1 may emit light with the first color (e.g., red), the second pixel PX2 may emit light with the second color (e.g., green), and the third pixel PX3 may emit light with the third color (e.g., blue).

The pixel PX may be connected to at least one of the scan lines SL1 to SLn and one of the data lines DL1 to DLm. For example, the first pixel PX1 may be connected to an i-th scan line SLi and a j-th data line DLj (here each of i and j is a positive integer). Similarly, the second pixel PX2 may be connected to the i-th scan line SLi and a j+1-th data line DLj+1, and the third pixel PX 3 may be the i-th scan line SLi and a j+2-th data line DLj+2.

The pixel PX may emit light with the brightness corresponding to a data signal provided through a data line (e.g., j-th data line DLj) in response to a scan signal (or gate signal provided at the present time) provided through a scan line SLi.

First and second power voltages VDD and VSS (illustrated, for example, in FIG. 2) may be provided to the display unit 110. The power voltages VDD and VSS may be voltages utilized or required for an operation of the pixel PX, and the first power voltage VDD may have a higher voltage level than a voltage level of the second power voltage VSS. The first and second power voltages VDD and VSS may be provided to the display unit 110 from a separate power supply unit or the power supply unit 160.

The scan driver 120 may generate a scan signal based on a scan control signal SCS and sequentially provide the scan signal to the scan lines SL1 to SLn. The scan control signal SCS may include a start signal, a clock signal, and the like, and may be provided from the timing controller 140. For example, the scan driver 120 may include a shift register (or stage) that sequentially generates and outputs a pulse type of a scan signal corresponding to a pulse type of a start signal using clock signals.

The data driver 130 may generate data signals (or data voltages) based on image data DATA2 and data control signal DCS provided from the timing controller 140 and provide the data signals to the display unit 110 (or pixel PX). Here, the data control signal DCS may be a signal that controls an operation of the data driver 130 and may include a load signal (or data enable signal) that commands an output of a valid data signal.

For example, the data driver 130 may generate a data signal corresponding to a grayscale value included in the image data DATA2 using gamma voltages GAMMAS. Here, the gamma voltages GAMMAS may be provided from the gamma voltage generator 170. Further details of the operation of the data driver 130 will be described in more detail later with reference to FIG. 3.

The timing controller 140 may receive input image data DATA1 and control signal CS from an external source (e.g., a graphic processor), generate the scan control signal SCS and the data control signal DCS based on the control signal CS, and generate the image data DATA2 by converting the input image data DATA1. Here, the control signal CS may include a vertical synchronization signal Vsync, a horizontal synchronization signal Hsync, a clock CLK, and the like. For example, the timing controller 140 may convert the input image data DATA1 having an RGB format into the image data DATA2 having an RGBG format corresponding to a pixel array in the display unit 110.

According to some example embodiments, the timing controller 140 may accumulate a grayscale value included in the image data DATA2 for each pixel to generate a driving time (or accumulated data, degradation data) for each pixel, and may compensate for the input image data DATA1 based on the accumulated data. The timing controller 140 may compensate for the grayscale value included in the input image data DATA1 (or image data DATA2) in response to the degradation of the pixel.

According to some example embodiments, the timing controller 140 may calculate a load of the input image data DATA1. For example, the timing controller 140 may calculate the load by averaging grayscale values included in the input image data DATA1, and the load may be expressed as a ratio with respect to the maximum load. The load of the input image data DATA1 may be used to extract the maximum voltage level of the data signal.

According to some example embodiments, the timing controller 140 may receive a power control signal C_AVDD1 (or first power control signal) and a gamma control signal C_GAMMAS1 (or first gamma control signal) from the storage 150, and may adjust a power control signal C_AVDD1 and the gamma control signal C_GAMMAS1 based on the maximum voltage level of the data signal. Here, the power control signal C_AVDD1 may include a first setting value representing a voltage level (or voltage information) of the gamma power voltage AVDD, and a voltage level of the gamma power voltage AVDD may be adjusted or changed according to the first setting value. The gamma control signal C_GAMMAS1 may include second setting values (or gamma setting values) representing a relative position (or size and voltage level) of each gamma voltage with respect to a voltage level of the gamma power voltage AVDD, and the voltage levels of the gamma voltages GAMMAS may be adjusted or changed according to the gamma power voltage AVDD and the second setting values. The maximum voltage level of the data signal may represent the largest (or highest) voltage level that the data signal can have. For example, the maximum voltage level of the data signal may correspond to a maximum grayscale value (e.g., grayscale value of 255) when the load of the input image data DATA1 is less than or equal to a reference load (e.g., 20%). The maximum voltage level will be described in more detail later with reference to FIG. 4A.

The storage 150 may store the power control signal C_AVDD1 and the gamma control signal C_GAMMAS1. In addition, the storage 150 may store the lookup table. The lookup table may include a relationship between grayscale values and gray voltages included in the image data DATA2 (or input image data DATA1). For example, the lookup table may include a selection value for a gray voltage corresponding to a specific gray value among the gray voltages. The gray voltages may be generated by dividing the gamma voltages GAMMAS. For example, more than 1000 gray voltages may be generated by dividing 9 gamma voltages GAMMAS, and only some among grayscale values corresponding to 256 grayscale values according to a selection value of the voltages may be selected. The lookup table may be set for each of pixels PX1, PX2, and PX3. The lookup table may be provided to the data driver 130 through the timing controller 140, and the data driver 130 may generate a data signal corresponding to the grayscale value based on the lookup table (or selection value).

The storage 150 may be implemented as a nonvolatile memory device (EEPROM), but embodiments according to the present invention are not limited thereto.

The power supply unit 160 may receive the adjusted power control signal C_AVDD2 (or the second power control signal) and generate the gamma power voltage AVDD based on the adjusted power control signal C_AVDD2. The voltage level of the gamma power voltage AVDD may change according to the adjusted power control signal C_AVDD2 and be proportional to the maximum voltage level of the data signal. A relationship between a change of the gamma power voltage AVDD and the gamma power voltage AVDD and the maximum voltage level of the data signal will be described in more detail later with reference to FIG. 5B.

The gamma voltage generator 170 may generate gamma voltages based on the gamma power voltage AVDD and the adjusted gamma control signal C_GAMMAS2 (or second gamma control signal). For example, the gamma voltage generator 170 may include at least one resistor string that consists of a plurality of resistors to select to divide the gamma power voltage AVDD, and decoders that selects a specific node of the at least one resistor string to output a node voltage (i.e., partial pressure) to a gamma voltage. In this case, the adjusted gamma control signal C_GAMMAS2 (and gamma control signal C_GAMMAS1) may include selection values for a specific node. For example, when the gamma voltage generator 170 generates nine gamma voltages GAMMAS, the adjusted gamma control signal C_GAMMAS2 may include nine selection values corresponding to nine gamma voltages GAMMAS.

Meanwhile, at least one of the scan driver 120, the data driver 130, the timing controller 140, the power supply unit 160, or the gamma voltage generator 170 may be formed in the display unit 110 or implemented as an IC to be connected to the display unit 110 in a form of a tape carrier package. In addition, at least two of the scan driver 120, the data driver 130, the timing controller 140, the power supply unit 160, and the gamma voltage generator 170 may be implemented as one IC.

Figure 2:
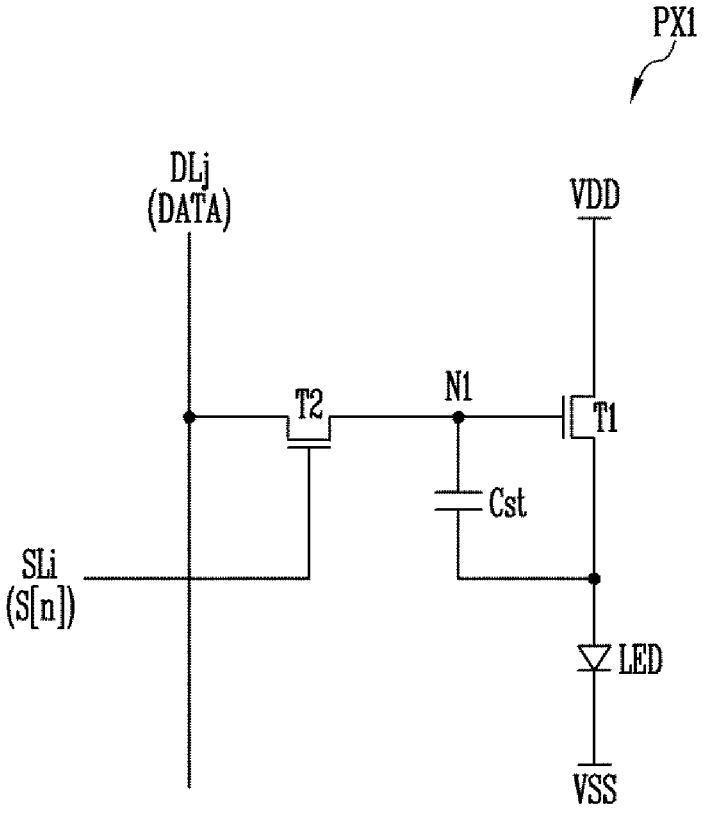
FIG. 2 is a circuit diagram showing an example of a pixel included in a display device of FIG. 1.

FIG. 2 is a circuit diagram showing an example of a pixel included in a display device of FIG. 1. Because the first pixel PX1, the second pixel PX2, and the third pixel PX3 shown in FIG. 1 are substantially equivalent to each other, the first pixel PX1 will be described including the first pixel PX1, the second pixel PX2 and the third pixel PX3.

Referring to FIGS. 1 and 2, the first pixel PX1 may include a light emitting element LED, a first transistor T1 (or driving transistor), a second transistor T2, and a storage capacitor Cst.

An anode of the light emitting element LED may be connected to a second electrode of the first transistor T1 and a cathode may be connected to a second driving power supply VSS. The light emitting element LED may be implemented as an organic light emitting diode, but is not limited thereto, and may be implemented as an inorganic light emitting diode. The light emitting element LED may emit light with brightness corresponding to an amount of current supplied from the first transistor T1.

A first electrode of the first transistor T1 may be connected to the first driving power supply VDD, and the second electrode may be connected to the anode of the light emitting element LED. A gate electrode of the first transistor T1 may be connected to a first node N1. The first transistor T1 controls the amount of current flowing in the light emitting element LED in response to a voltage of the first node N1.

A first electrode of the second transistor T2 may be connected to the data line DLj, and the second electrode of the second transistor T2 may be connected to the first node N1. A gate electrode of the second transistor T2 may be connected to the scan line SLi. The second transistor T2 may be turned on when a scan signal S[n] is supplied to the scan line SLi to transfer a data signal DATA from the data line DLj to the first node N1.

The storage capacitor Cst may be connected between the first node N1 and the anode of the light emitting element LED. The storage capacitor Cst may store a voltage of the first node N1.

The first transistor T1 and the second transistor T2 are shown to be implemented as an N-type transistor in FIG. 2, but the embodiment illustrated in FIG. 2 is an example, and embodiments according to the present invention are not limited thereto. For example, according to some example embodiments, the first transistor T1 and the second transistor T2 may be implemented as a P-type transistor. In addition, a circuit structure of the first pixel PX1 shown in FIG. 2 is an example, and a circuit structure of the first pixel PX1 according to embodiments of the present invention is not limited thereto. For example, the first pixel PX1 may further include a circuit element (e.g., a sensing transistor connected to an anode of a light emitting element LED and a separate sensing line) for measuring an emitting characteristic of the light emitting element LED and/or a threshold voltage of the first transistor T1.

Figure 3:
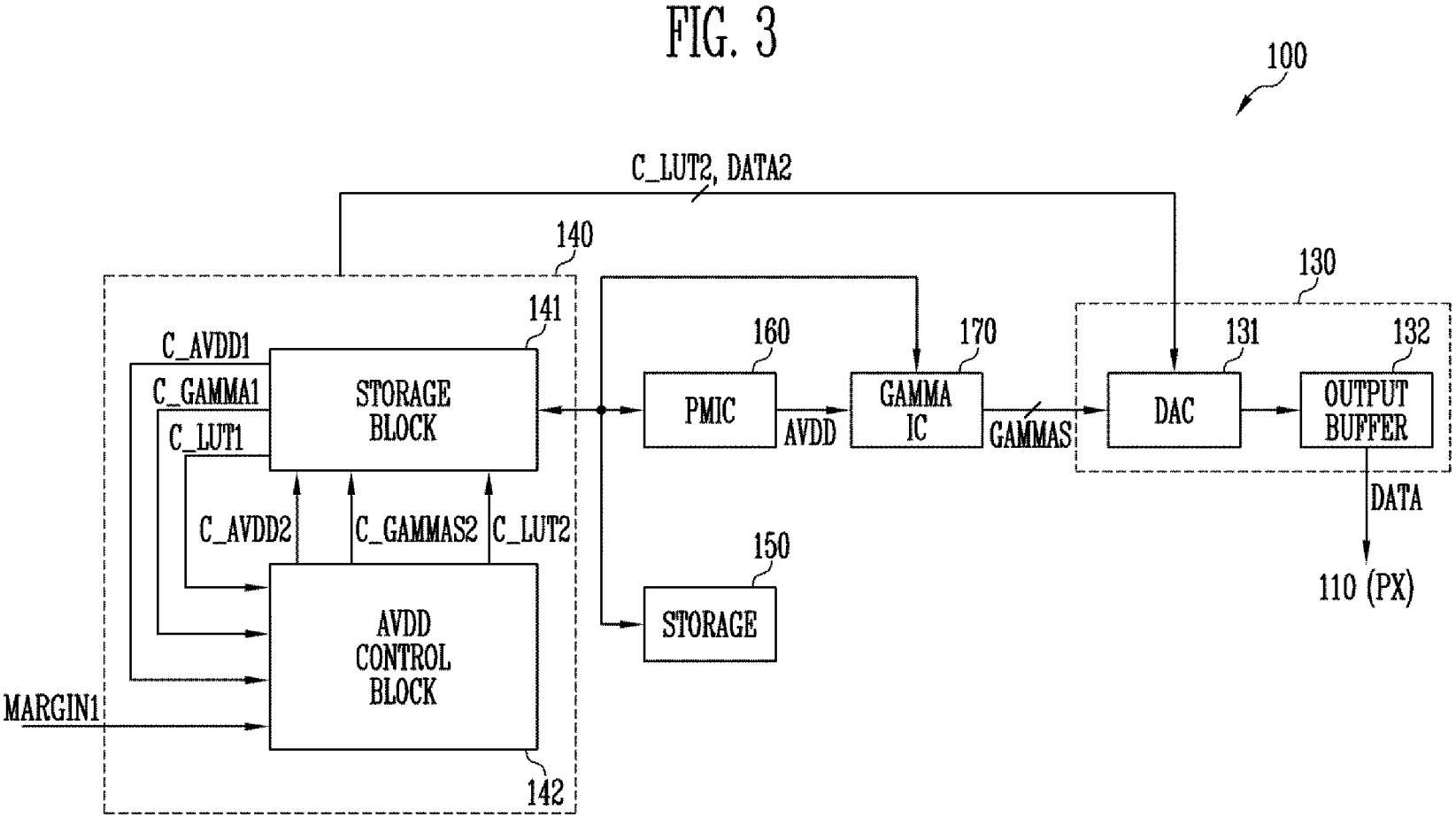
FIG. 3 is a block diagram showing an example of a display device of FIG. 1.

FIG. 3 is a block diagram showing an example of a display device of FIG. 1. The display device 100 is briefly shown focusing on control function of a gamma power of the timing controller 140 in FIG. 3.

Referring to FIGS. 1 and 3, the timing controller 140 may include a storage block 141 and a power control block 142 (or power controller).

The storage block 141 (or memory device) may load the first setting value of the power control signal C_AVDD1, the second setting values of the gamma control signal C_GAMMAS1, and the lookup table C_LUT1 (or lookup table code) from the storage 150. As described above, the lookup table C_LUT1 may include a selection value for a gray voltage corresponding to the grayscale value among gray voltages. The storage block 141 may be implemented as a nonvolatile memory device or a volatile memory device.

The power control block 142 may calculate the maximum voltage level of the data signal based on the power control signal C_AVDD1 (or first setting value), the gamma control signal C_GAMMAS1 (or at least one of the second setting values), and the lookup table, may calculate the target voltage level of the gamma power voltage AVDD based on the maximum voltage level of the data signal and the margin setting value MARGIN1 provided from the external, and may adjust or update the first setting value of the power control signal C_AVDD1, the second setting values of the gamma control signal C_GAMMAS1 and the selection values of the lookup table C_LUT1 based on the target voltage level, respectively.

After describing a more specific operation of the power control block 142, other components (e.g., data driver 130) will be described.

Figure 4A:
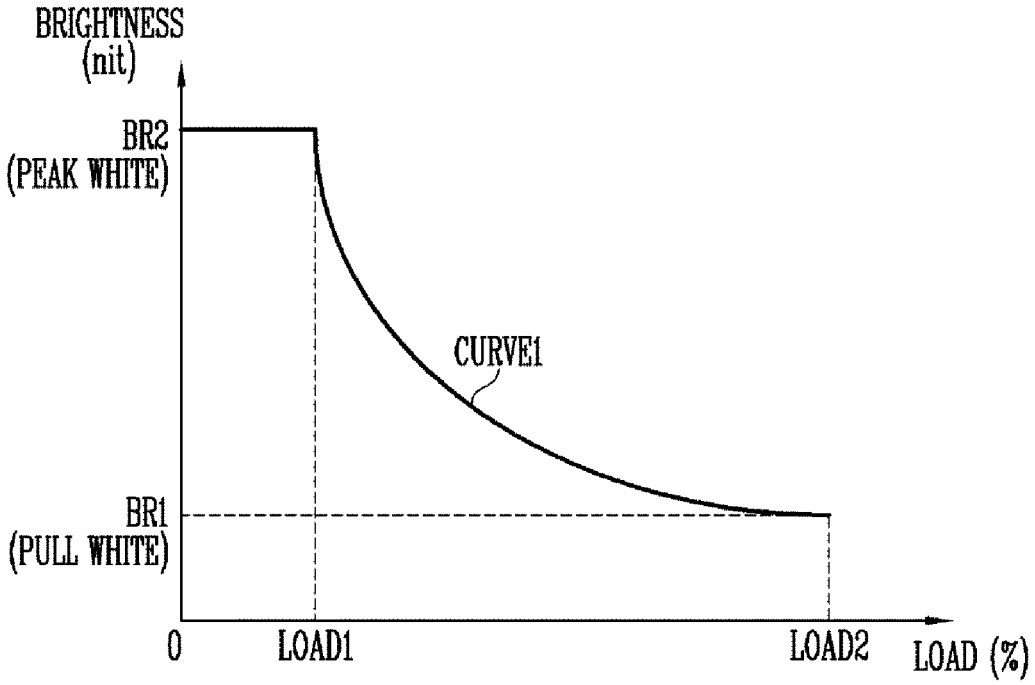
FIG. 4A is a drawing showing a change of the maximum brightness of a display device of FIG. 1.
Figure 4B:
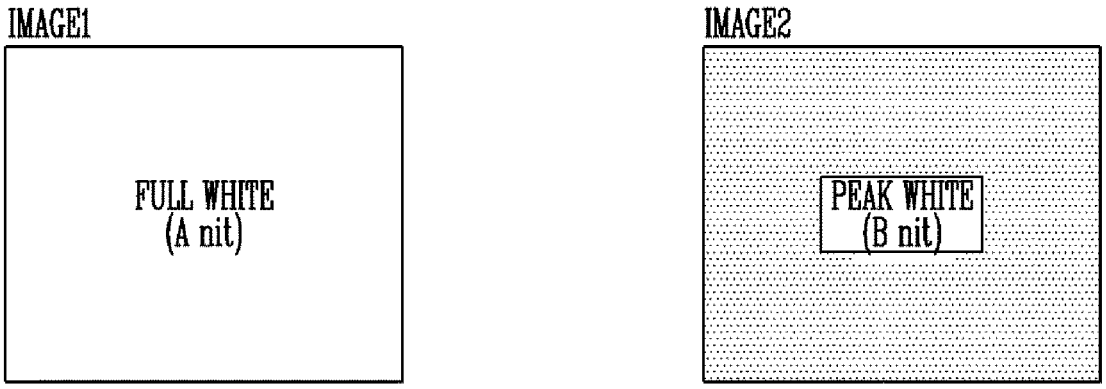
FIG. 4B is a drawing showing an example of an image displayed on a display device of FIG. 1.

FIGS. 4A and 4B may be referenced to describe the maximum voltage level of the data signal according to some example embodiments.

FIG. 4A is a drawing showing a change of the maximum brightness of a display device of FIG. 1. FIG. 4B is a drawing showing an example of an image displayed on a display device of FIG. 1.

Referring to FIGS. 1, 4A and 4B, the maximum brightness of the display device 100 may change according to a load of the input image data DATA1 (see FIG. 1). Here, the load LOAD may be calculated based on grayscale values included in the input image data DATA1 in the timing controller 140. For example, the load LOAD may be an average grayscale value of the input image data DATA1.

When the load LOAD of the display device 100 is less than or equal to a first reference load LOAD1, the maximum brightness may have a second brightness value BR2. For example, the second image IMAGE2 shown in FIG. 4B may have maximum brightness PEAK WHITE in some areas and black brightness in the other areas. That is, the input image data DATA1 corresponding to the second image IMAGE2 may have a maximum grayscale value (e.g., a grayscale value of 255) only in some areas and a minimum grayscale value (e.g., a grayscale value of 0) in the other areas. In this case, the load LOAD may be less than or equal to the first reference load LOAD1 (e.g., 20%), and the brightness in some areas may be B nits (e.g., 500 nit).

As the load LOAD of the display device 100 increases beyond the first reference load LOAD1, the maximum brightness may decrease.

When the load LOAD of the display device 100 is the second reference load LOAD2 or more, the maximum brightness may have a first brightness value BR1.

For example, the first image IMAGE1 shown in 4B may be a full white image FULL WHITE having the maximum brightness in the entire area. That is, the input image data DATA1 corresponding to the first image IMAGE1 may have the maximum grayscale value (e.g., grayscale value of 255) in the entire area. In this case, the load LOAD may be the second reference load LOAD2 (e.g., 80%) or more, and the entire brightness of the first image IMAGE1 may be A nits (e.g., 150 nit).

That is, the current flowing in the pixel PX to represent the maximum brightness PEAK WHITE of the second image IMAGE2 may be greater than the current flowing in the pixel PX to represent the first image IMAGE1, and the data signal (i.e., the data signal corresponding to the maximum grayscale value) corresponding to the second image IMAGE2 may be greater than the data signal corresponding to the first image IMAGE1 according to the circuit structure of the pixel PX (see FIG. 2).

Therefore, the maximum voltage level of the data signal may correspond to the maximum grayscale value (e.g., grayscale value of 255) when the load LOAD of the input image data DATA1 is less than or equal to the first reference load LOAD1, and may be greater than the voltage level corresponding to the maximum grayscale value when the load LOAD of the input image data DATA1 is greater than the first reference load LOAD1.

Referring back to FIG. 3, the power control block 142 may calculate the expected voltage level of the gamma power voltage AVDD based on the first setting value of the power control signal C_AVDD1, may calculate the first gamma voltage based on the expected voltage level of the gamma power voltage AVDD and the first gamma setting value C_GAMMA1 (or first gamma code) among the second setting values of the gamma control signal C_GAMMAS1, and may calculate the maximum voltage level of the data signal DATA based on the first gamma voltage and the lookup table C_LUT1. Here, the first gamma voltage may have the largest voltage level among the gamma voltages.

In addition, the power control block 142 may calculate the target voltage level of the gamma power voltage AVDD based on the maximum voltage level of the data signal DATA and the margin setting value MARGIN1 provided from an external source, and may adjust the power control signal C_AVDD1, the gamma control signal C_GAMMAS1, and the lookup table C_LUT1 based on the target voltage level.

Figure 5A:
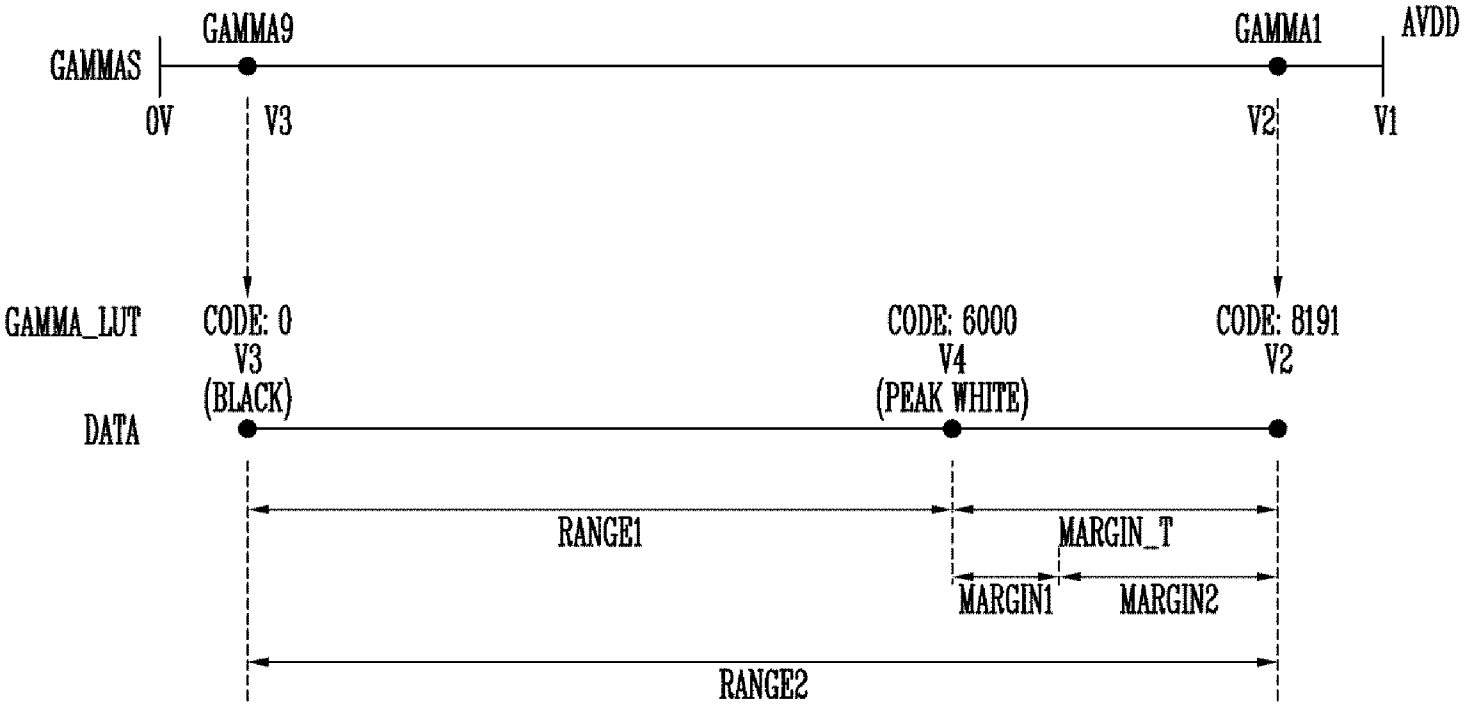
FIG. 5A is a drawing showing a relationship between a gamma power voltage and a data signal.
Figure 5B:
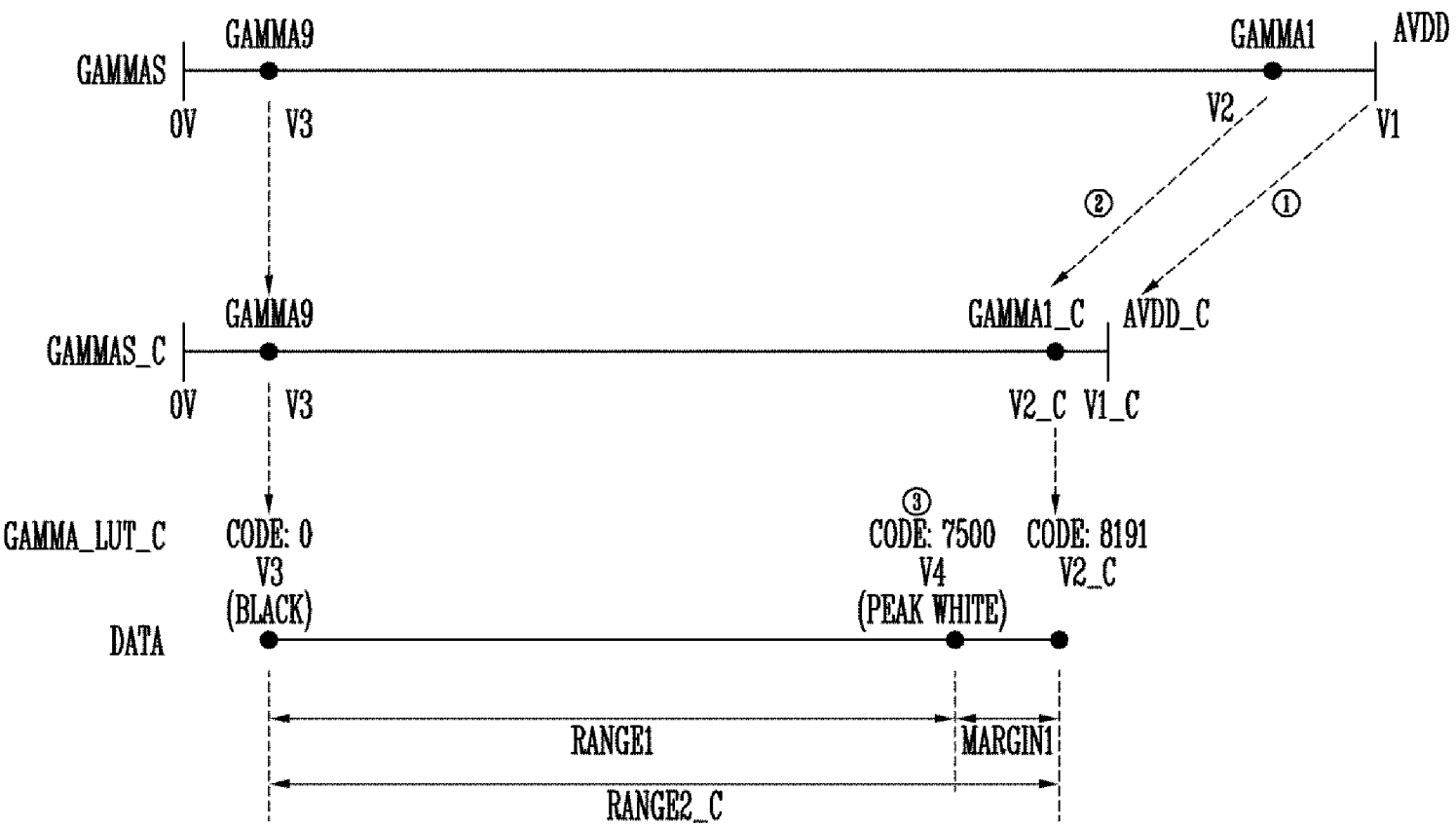
FIG. 5B is a drawing showing a change of a gamma power voltage by a display device of FIG. 3.

FIGS. 5A and 5B may be referenced to describe a configuration adjusting the power control signal C_AVDD1, the gamma control signal C_GAMMAS1, and lookup table C_LUT1 in the power control block 142.

FIG. 5A is a drawing showing a relationship between a gamma power voltage and a data signal. FIG. 5B is a drawing showing a change of a gamma power voltage by a display device of FIG. 3.

First, referring to FIG. 5A, the gamma power voltage AVDD may have a first voltage level V1 according to the power control signal C_AVDD1. For example, the first voltage level V1 may be 13.5V. The gamma power voltage AVDD may be set high enough in consideration of various display devices and various margin setting values.

The gamma voltages GAMMAS may be generated by dividing the gamma power voltage AVDD and the reference voltage (e.g., ground, 0 V). For example, the first gamma voltage GAMMA1 among the gamma voltages GAMMAS may have a second voltage level V2 (e.g., 12.5 V), and the last gamma voltage GAMMA9 (or the ninth gamma voltage) among the gamma voltages GAMMAS may have a third voltage level V3 (e.g., 1.0V).

Meanwhile, the maximum voltage level (i.e., voltage level at maximum brightness PEAK WHITE) of the data signal DATA may have a fourth voltage level V4 and may be, for example, 8.4V. As described above, the maximum voltage level of the data signal DATA may be derived by the lookup table C_LUT1 when the load LOAD of the input image data DATA1 is less than or equal to the first reference load LOAD1.

For example, the lookup table C_LUT1 may include a selection value CODE of "6000" corresponding to the fourth voltage level V4 (or the maximum voltage level) and a selection value CODE of "8191" corresponding to a second voltage level V2 (or first gamma voltage GAMMA1). In addition, the lookup table C_LUT1 may include a selection value CODE of "0" corresponding to a third voltage level V3 (or the last gamma voltage GAMMA9). In this case, the timing controller 140 may calculate the maximum voltage level of the data signal DATA based on the first gamma voltage GAMMA1 and the selection values. The selection value CODE may be described as having a value of 13 bits according to some example embodiments, but the embodiments are not limited thereto.

A reference voltage range of the data signal DATA may be derived as a first range RANGE1 (e.g., 1.0V to 8.4V) between the third voltage level V3 and the fourth voltage level V4.

Meanwhile, a compensation margin MARGIN_T (e.g., 8.4 V to 12.5 V) between the first gamma voltage GAMMA1 (or second voltage level V2) and the maximum voltage level (or fourth voltage level V4) of the data signal DATA may be set for a degradation compensation of the pixel PX (see FIG. 1).

However, a margin setting value MARGIN1 (or first compensation margin) for the degradation compensation of an actual pixel PX is in a range of about 10% to 15% of the maximum voltage level (e.g., fourth voltage level V4) of the data signal DATA. For example, the margin setting value MARGIN1 may be about 1.0V. For example, a compensation margin for compensating for a threshold voltage of a transistor in the pixel PX may be about 0.5V, and a compensation margin for compensating for the degradation of a light emitting element in the pixel PX may be about 0.5V.

The other compensation margin MARGIN2 (or second compensation margin) may not use, for example, a voltage range between 8.4V to 12.5V.

That is, the maximum voltage range of the data signal DATA may be set to the second range RANGE2 (e.g., 1.0V to 12.5V) according to the gamma power voltage AVDD and the first gamma voltage GAMMA1, but the other compensation margin MARGIN2 may be not used to generate the data signal DATA, and only increase power consumption.

Accordingly, the display device (or timing controller 140 and power control block 142) according to some example embodiments of the present invention may adjust the gamma power voltage AVDD based on the reference voltage range (i.e., first range RANGE1) of the data signal DATA and the margin setting value MARGIN1.

Referring to FIG. 5B, the power control block 142 may calculate the maximum voltage level (e.g., fourth voltage level V4) of the data signal DATA, and adjust or reset the first gamma voltage GAMMA1 and the gamma power voltage AVDD based on the maximum voltage level of the data signal DATA.

For example, the power control block 142 may set a first gamma voltage GAMMA1_C to have a voltage level (e.g., second voltage level V2_C of about 9.4 V) greater than the maximum voltage level of the data signal DATA by the margin setting value MARGIN1. For example, the power control block 142 may set the gamma power voltage AVDD to have a voltage level (e.g., first voltage level V1_C of about 10.4 V) greater than a voltage level of the first gamma voltage GAMMA1_C by the margin setting value MARGIN1. For another example, the power control block 142 may set the gamma power voltage AVDD to have a voltage level greater than the maximum voltage level of the data signal DATA by the margin setting value MARGIN1.

Therefore, the voltage level of the gamma power voltage AVDD may be reduced, and the voltage level of the first gamma voltage GAMMA1_C may be reduced. Meanwhile, the selection value CODE for the maximum voltage level of the data signal DATA may be changed from the existing "6000" to "7500".

Referring back to FIG. 3, the adjusted power control signal C_AVDD2, the adjusted gamma control signal C_GAMMAS2, and the adjusted lookup table C_LUT1 may be stored in the storage 150 through the storage block 141.

The power control block 142 may adjust the power control signal C_AVDD1, the gamma control signal C_GAMMAS1, and the lookup table C_LUT1 in the manufacturing process (e.g., optical compensation process) of the display device 100, but is not limited thereto. For example, the power control block 142 may adjust the power control signal C_AVDD1, the gamma control signal C_GAMMAS1, and the lookup table C_LUT1 when a specific event occurs (e.g., when the display device 100 is turned on), or periodically (e.g., whenever a drive time of the display device 100 passes a reference time).

The power supply unit 160 may generate the gamma power voltage AVDD based on the power control signal C_AVDD1 or the adjusted power control signal C_AVDD2 provided from the storage 150 through the timing controller 140. For example, the power supply unit 160 may generate the gamma power voltage AVDD based on the power control signal C_AVDD1 at an initial driving, and generate the gamma power voltage AVDD based on the adjusted power control signal C_AVDD2 when the power control signal C_AVDD1 in the storage 150 is update with the adjusted power control signal C_AVDD2.

The gamma voltage generator 170 may generate the gamma voltages GAMMAS based on the gamma power voltage AVDD and the gamma control signal C_GAMMAS1 (or adjusted gamma control signal C_GAMMAS2). For example, the gamma voltage generator 170 may generate the gamma voltages GAMMAS based on the gamma control signal C_GAMMAS1 at the initial driving, and generate the gamma voltages AVDD based on the adjusted gamma control signal C_GAMMAS2 when the gamma control signal C_GAMMAS1 in the storage 150 is update with the adjusted gamma control signal C_GAMMAS2.

Meanwhile, the timing controller 140, the storage 150, the power supply unit 160, and the gamma voltage generator 170 may transfer signals to each other using an I2C (or two wire interface (TWI)) communication technology.

The data driver 130 may include a decoder 131 (or digital-analog converter DAC) and an output buffer 132. The data driver 130 may further include a shift register, a latch, and the like.

The decoder 131 may generate a data signal DATA corresponding to the grayscale value in the image data DATA2 based on the gamma voltages GAMMAS and the lookup table C_LUT1 (or the adjusted or updated lookup table C_LUT2). The image data DATA2 and the lookup table C_LUT1 may be provided to the decoder 131 from the data driver 130 through an unified standard interface (USI). For example, the decoder 131 may generate gray voltages by dividing the gamma voltages GAMMAS, and convert a grayscale value of a digital form in image data DATA2 to the data signal DATA (or data voltage) of an analog form based on the gray voltages and the adjusted lookup table C_LUT2.

The output buffer 132 may provide the data signal DATA to the display unit 110 (or pixel PX).

As described with reference to FIGS. 3 to 5B, the timing controller 140 may adjust or update the power control signal C_AVDD1 (or gamma power voltage AVDD), the gamma control signal C_GAMMAS1 (or gamma voltages GAMMAS), the first gamma voltage GAMMA1, and the lookup table C_LUT1 based on the maximum voltage level of the data signal DATA. Accordingly, the gamma power voltage AVDD may be reduced and the power consumption of the display device 100 may be reduced.

Figure 6:
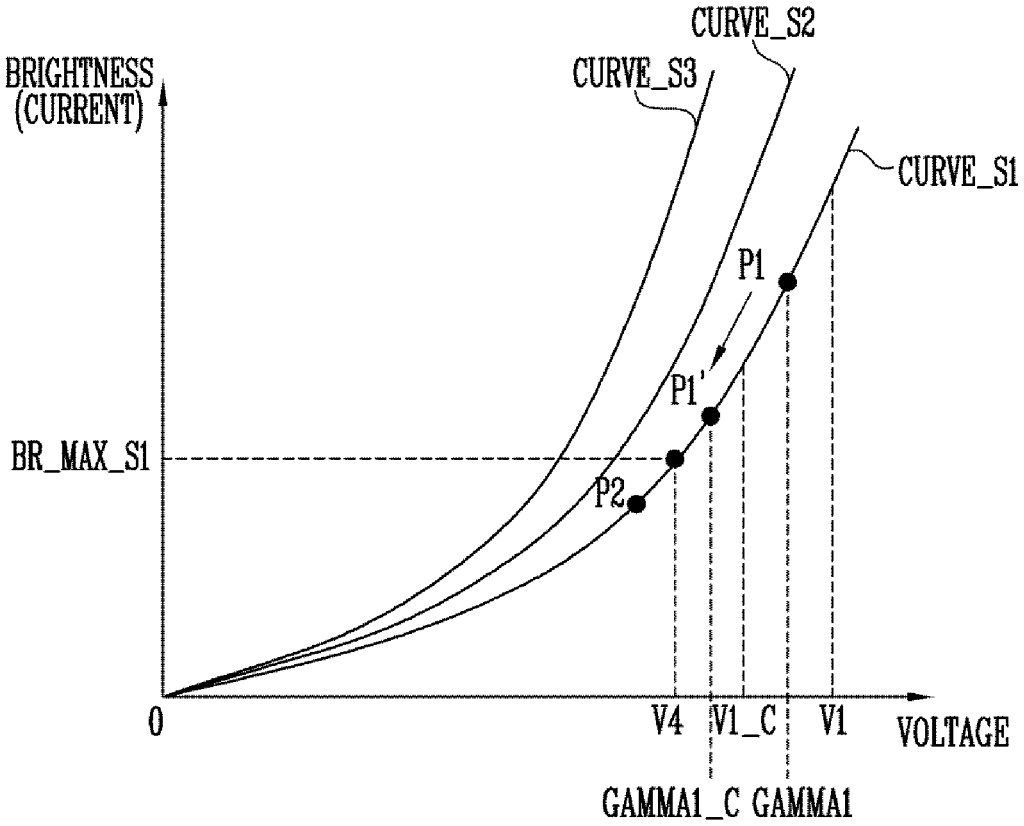
FIG. 6 is a graph showing an example of an emitting characteristic of pixels included in a display device of FIG. 1.

FIG. 6 is a graph showing an example of an emitting characteristic of pixels included in a display device of FIG. 1.

Referring to FIGS. 1, 3 and 6, a first curve CURVE_S1 may represent the emitting characteristic (or relationship between a voltage and a brightness (or current)) of the first pixel PX1 (e.g., red pixel), a second curve CURVE_S2 may represent the emitting characteristic of the second pixel PX2 (e.g., green pixel), and a third curve CURVE_S3 may represent the emitting characteristic of the third pixel PX3 (e.g., blue pixel). Although the same data signal (e.g., fourth voltage level V4) is applied to the first to third pixels PX1, PX2, and PX3, the first to third pixels PX1, PX2, and PX3 may emit light with different brightness according to a size, color, etc. of the light emitting element included in the pixel PX. That is, operating points (e.g., data voltage for emitting with the maximum brightness) of the first to third pixels PX1, PX2, and PX3 may be different from each other.

According to some example embodiments, the data driver 130 (or power control block 142) may calculate a first maximum voltage level of the data signal DATA for the first pixel PX1, a second maximum voltage level of the data signal DATA for the second pixel PX2, and a third maximum voltage level of the data signal DATA for the third pixel PX3, and adjust the gamma power voltage AVDD based on the first to third maximum voltage levels.

According to some example embodiments, the data driver 130 may calculate a first maximum voltage level of the data signal DATA for the first pixel PX1 and adjust the gamma power voltage AVDD based on the first maximum voltage level. Here, the first maximum voltage level of the first pixel PX1 may be greater than the second maximum voltage level of the second pixel PX2 and the second maximum voltage level of the third pixel PX3. For example, when the gamma voltage generator 170 commonly generates the gamma voltages GAMMAS for the first to third pixels PX1, PX2, and PX3, the data driver 130 may adjust the gamma power voltage AVDD based on the first maximum voltage level of the first pixel PX1.

As described with reference to FIG. 5B, the maximum voltage level of the data signal DATA at which the first pixel PX1 emits light with the maximum brightness BR_MAX_S1 may be the fourth voltage level V4. Accordingly, the display device 100 may reduce the gamma power voltage AVDD to the first voltage level V1_C. When the first gamma voltage GAMMA1 is greater than the first voltage level V1_C, the first gamma voltage GAMMA1 corresponding to a first point P1 may be reduced to the first gamma voltage GAMMA1_C corresponding to a first compensated point P1'.

Meanwhile, the first gamma voltage GAMMA1, the reduced first gamma voltage GAMMA1_C, the first point P1 corresponding to the second gamma voltage, the first compensated point P1', the second point P2, and the like may be inflection points (i.e., points at which a slope of a tangent line changes abruptly) of the third curve CURVE_S3.

According to some example embodiments, the data driver 130 may calculate the first maximum voltage level of the data signal DATA for the first pixel PX1, adjust a first sub-power control signal based on the first maximum voltage level, calculate the second maximum voltage level of the data signal DATA for the second pixel PX2, adjust the second sub-power control signal based on the second maximum voltage level, calculate the third maximum voltage level of the data signal DATA for the third pixel PX3, and adjust the third sub-power control signal based on the third maximum voltage level. Here, the first to third sub-power control signals may be included in the power control signal C_AVDD1. For example, when the gamma voltage generator 170 includes first to third sub-gamma voltage generating circuits that generate gamma voltages GAMMAS for the first to third pixels PX1, PX2, and PX3, respectively, a first sub-gamma power voltage for the first sub-gamma voltage generating circuit may be adjusted based on the first sub-control signal, a second sub-gamma power voltage for the second sub-gamma voltage generating circuit may be adjusted based on the second sub-control signal, and a third sub-gamma power voltage for the third sub-gamma voltage generating circuit may be adjusted based on the third sub-control signal. In this case, the power consumption of the display device 100 may be further reduced.

As described with reference to FIG. 6, when the display device 100 includes pixels PX1, PX2, and PX3 having different operating points, the display device 100 may calculate all the maximum voltage levels of the data signal for each of the pixels PX1, PX2, and PX3, or may calculate the maximum voltage level of a data signal for a specific pixel among pixels PX1, PX2, and PX3, and then may adjust the gamma power voltage AVDD based on a calculation result.

Figure 7:
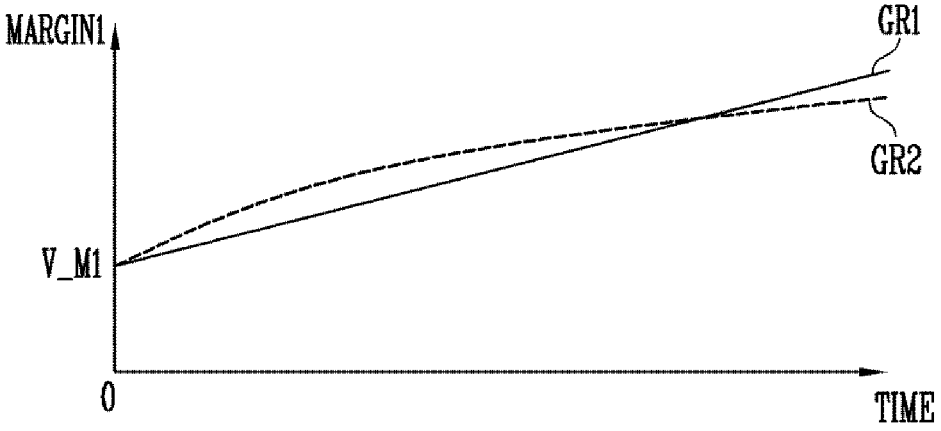
FIG. 7 is a drawing showing an example of a margin setting value provided to a display device of FIG. 3.

FIG. 7 is a drawing showing an example of a margin setting value provided to a display device of FIG. 3.

Referring to FIGS. 3 and 7, as the driving time TIME of the display device 100 (or display unit 110, see FIG. 1) increases, the margin setting value MARGIN1 may increase. Here, the driving time TIME may be proportional to the grayscale value and the light emitting time, and may be weighted according to driving conditions such as temperature.

For example, the margin setting value MARGIN1 may have an initial setting value V_M1 (e.g., 1.0 V) and may increase linearly in proportion to the driving time TIME along a first graph GR1. For another example, the margin setting value MARGIN1 may increase along the second graph GR2, and an increase in the margin setting value MARGIN1 may be reduced as the driving time TIME increases. However, the embodiments described above, are merely examples according to some embodiments, and a change of the margin setting value MARGIN1 according to various embodiments is not limited thereto. For example, according to some example embodiments, the margin setting value MARGIN1 may increase in steps (or stepwise).

The voltage level of the gamma power voltage AVDD may increase in proportion to the margin setting value MARGIN1. That is, the voltage level of the gamma power voltage AVDD at the present time may be higher than the voltage level of the gamma power voltage AVDD at the previous time.

Figure 8:
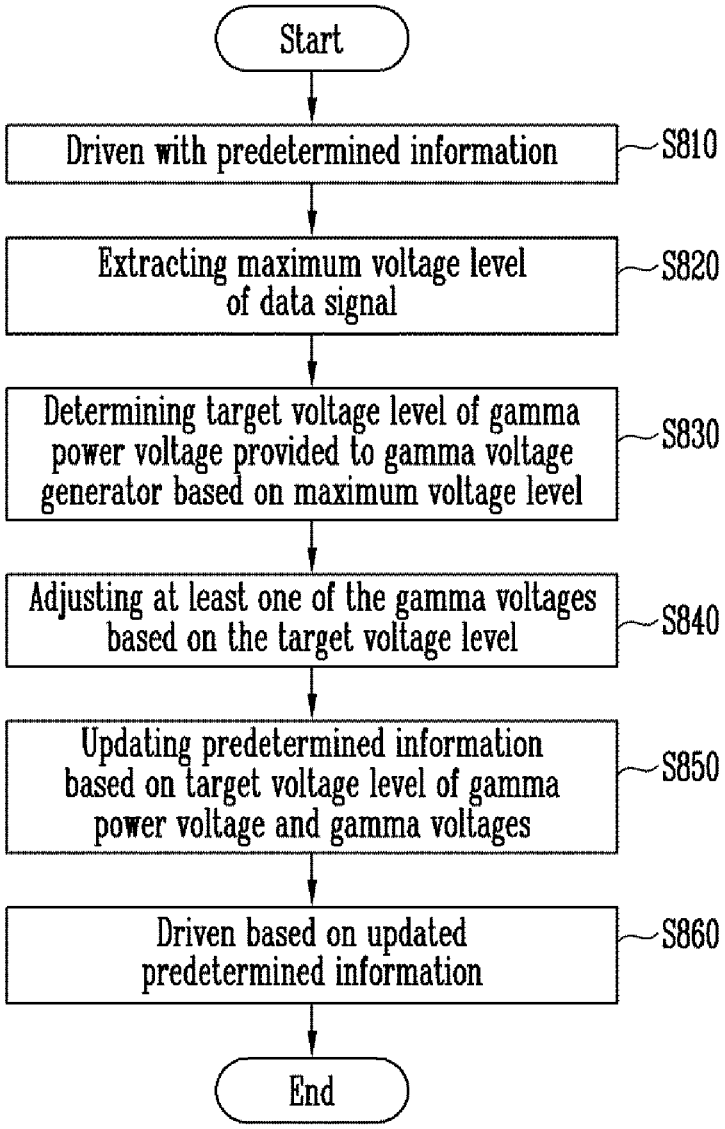
FIG. 8 is a flowchart showing a driving method of a display device according to some example embodiments of the present invention.

FIG. 8 is a flowchart showing a driving method of a display device according to some example embodiments of the present invention.

Referring to FIGS. 1, 3 and 8, a method of FIG. 8 may be performed on the display device 100 of FIG. 1.

The method of FIG. 8 may be driven with information (e.g., set or predetermined information) (S810).

For example, the information (e.g., the set or predetermined information) may include the power control signal C_AVDD1, the gamma control signal C_GAMMAS1, and the lookup table C_LUT1 as described with reference to FIG. 3.

For example, when the display device 100 is turned on (or at the initial driving, when an optical compensation process is performed), the timing controller 140 may read the power control signal C_AVDD1 stored in the storage 150, the gamma control signal C_GAMMAS1, and the lookup table C_LUT1 to provide them to the power supply unit 160, the gamma voltage generator 170, and the data driver 130.

According to some example embodiments, the timing controller 140 may compensate for the grayscale value included in the input image data DATA1 based on characteristic information (e.g., threshold voltage of the driving transistor) of the pixel PX detected through an external compensation circuit. In this case, the maximum voltage level of the data signal DATA generated based on the grayscale value may be changed.

According to some example embodiments, the gamma voltage generator 170 may adjust the gamma voltages based on the characteristic information of the pixel PX. For example, the gamma voltage generator 170 may adjust the gamma voltages by giving the gamma voltages an offset value which is changed based on the characteristic information of the pixel PX.

Therefore, an actual voltage range of the data signal may be determined.

Next, the method of FIG.8 may extract the maximum voltage level of the data signal DATA (S820).

Here, as described with reference to FIG. 4A, the maximum voltage level of the data signal DATA may correspond to the maximum grayscale value (e.g., grayscale value of 255) when the load of the input image data DATA1 is less than or equal to the reference load (e.g., 20%).

As described with reference to FIGS. 3 and 5A, the method of FIG. 8 may calculate the first gamma voltage GAMMA1 having the largest voltage level among the gamma voltages GAMMAS based on the gamma power voltage AVDD and the first setting value, and calculate the maximum voltage level of the data signal DATA based on the first gamma voltage GAMMA1 and the lookup table (e.g., the set or predetermined lookup table) C_LUT1. Here, the first setting value may be included in the gamma control signal C_GAMMAS1 and represent a relative position of the gamma voltages GAMMAS based on the voltage level of the gamma power voltage AVDD.

That is, the maximum voltage level of the data signal DATA may be derived through the lookup table C_LUT1 or obtained through a separate sensor as described with reference to FIGS. 3 and 5A.

The method of FIG. 8 may determine the target voltage level of the gamma power voltage AVDD based on the maximum voltage level of the data signal DATA (S830).

As described with reference to FIG. 5B, the method of FIG. 8 may determine the target voltage level of the gamma power voltage AVDD based on the maximum voltage level and the margin setting value MARGIN1 of the data signal DATA. For example, the target voltage level of the gamma power voltage AVDD may be calculated by summing the maximum voltage level of the data signal DATA and the margin setting value MARGIN1. Therefore, the target voltage level of the gamma power voltage AVDD may be proportional to the maximum voltage level of the data signal DATA.

In addition, the method of FIG. 8 may adjust at least one of the gamma voltages by changing the gamma control signal C_GAMMAS1 based on the target voltage level of the gamma power voltage AVDD (S840).

As described with reference to FIG. 5B, the method of FIG. 8 may adjust the first gamma voltage GAMMA1 to have a voltage level greater than the maximum voltage level of the data signal DATA by the margin setting value MARGIN1.

Next, the method of FIG. 8 may update the information (e.g., the set or predetermined information) based on the target voltage level of the gamma power voltage AVDD (or adjusted gamma power voltage AVDD_C, see FIG. 5B) and the changed gamma voltages (e.g., adjusted first gamma voltage GAMMA1_C).

That is, the method of FIG. 8 may store the target voltage level (or adjusted power control signal C_AVDD2) of the gamma power voltage AVDD and the adjusted gamma control signal C_GAMMAS2 in the storage 150 (S850). In addition, the method of FIG. 8 may store the adjusted lookup table C_LUT2 in the storage 150.

Next, the method of FIG. 8 may be driven based on the updated information (e.g., the updated set or predetermined information) (i.e., adjusted power control signal C_AVDD2 stored in the storage 150) and the adjusted gamma control signal C_GAMMAS2 (S860).

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The drawing and the detailed description of the present invention referred to above are descriptive sense only and are used for the purpose of illustration only and are not intended to limit the meaning thereof or to limit the scope of the invention described in the claims. Accordingly, a person having ordinary skill in the art will understand from the above that various modifications and other equivalent embodiments are also possible. Therefore, the real protective scope of the present invention shall be determined by the technical scope of the accompanying claims, and their equivalents.

What is claimed is:

1. A display device comprising:

a display panel including a plurality of pixels;

a power supply configured to generate a gamma power voltage based on a power control signal;

a gamma voltage generator configured to generate gamma voltages based on the gamma power voltage and a gamma control signal;

a data driver configured to generate a data signal corresponding to a grayscale value included in image data using the gamma voltages and to provide the data signal to the pixels; and a power controller configured to adjust the power control signal and the gamma control signal based on a maximum voltage level of the data signal, wherein a voltage level of the gamma power voltage is proportional to the maximum voltage level of the data signal.

2. The display device of claim 1, further comprising:

a storage configured to store a first setting value for the power control signal, second setting values for the gamma control signal, and a lookup table, wherein the first setting value represents the voltage level of the gamma power voltage, the second setting values represent a relative position of the gamma voltages with respect to the voltage level of the gamma power voltage, the lookup table includes a selection value for gray voltage corresponding to the grayscale value among gray voltages, and the gray voltages are generated by dividing the gamma voltages.

3. The display device of claim 2, wherein the power controller includes:

a storage block configured to load the first setting value of the power control signal, the second setting values of the gamma control signal, and the lookup table from the storage; and a power control block configured to calculate the maximum voltage level of the data signal based on the first setting value, the second setting values, and the lookup table, to calculate a target voltage level of the gamma power voltage based on the maximum voltage level of the data signal and a margin setting value, and to update the first setting value of the power control signal and the second setting values of the gamma control signal based on the target voltage level, respectively.

4. The display device of claim 3, wherein the pixels include a first pixel configured to emit light with a first color, a second pixel configured to emit light with a second color, and a third pixel configured to emit light with a third color, and the maximum voltage level of the data signal corresponds to the first pixel.

5. The display device of claim 3, wherein the margin setting value increases as a driving time of the display panel increases.

6. The display device of claim 3, wherein the power controller is configured to calculate an expected voltage level of the gamma power voltage based on the first setting value, to calculate a first gamma voltage based on the expected voltage level of the gamma power voltage and a first gamma setting value among the second setting values, and to calculate a maximum voltage level of the data signal based on the first gamma voltage and the lookup table, and wherein the first gamma voltage has a largest voltage level of the gamma voltages.

7. The display device of claim 6, wherein the first gamma voltage has a voltage level that is greater than the maximum voltage level of the data signal by the margin setting value, and wherein the margin setting value is in a range of 10% to 15% of the maximum voltage level of the data signal.

8. The display device of claim 7, wherein the voltage level of the gamma power voltage is greater than the voltage level of the first gamma voltage by the margin setting value.

9. The display device of claim 6, wherein the selection value of the lookup table is variable.

10. The display device of claim 6, wherein the maximum voltage level of the data signal corresponds to a maximum grayscale value when a load of the image data is less than or equal to a reference load, and is greater than a voltage level corresponding to the maximum grayscale value when the load of the image data is greater than the reference load.

11. A driving method of a display device, wherein the display device is configured to:

generate gamma voltages based on a gamma power voltage and a gamma control signal;

generate a data signal corresponding to a grayscale value included in image data using the gamma voltages; and provide the data signal to pixels, the driving method comprising:

extracting a maximum voltage level of the data signal;

determining a target voltage level of the gamma power voltage based on the maximum voltage level; and adjusting at least one of the gamma voltages by changing the gamma control signal based on the target voltage level of the gamma power voltage, wherein the target voltage level of the gamma power voltage is proportional to the maximum voltage level of the data signal.

12. The driving method of claim 11, further comprising:

storing the target voltage level of the gamma power voltage and the changed gamma control signal in a storage.

13. The driving method of claim 12, wherein a target voltage level of the gamma power voltage is determined based on the maximum voltage level of the data signal and a margin setting value.

14. The driving method of claim 13, wherein the extracting the maximum voltage level of the data signal includes:

calculating a first gamma voltage having a largest voltage level among the gamma voltages based on the gamma power voltage and a first gamma setting value; and calculating the maximum voltage level of the data signal based on the first gamma voltage and a predetermined lookup table, wherein the first gamma setting value represents a relative position of the first gamma voltage with respect to the voltage level of the gamma power voltage, wherein the lookup table includes a selection value for a gray voltage corresponding to the grayscale value among gray voltages, wherein the gray voltages are generated by dividing the gamma voltages, and wherein the target voltage level of the gamma power voltage is calculated by summing the maximum voltage level of the data signal and the margin setting value.

15. The driving method of claim 14, wherein the maximum voltage level of the data signal corresponds to a maximum grayscale value when a load of the image data is less than or equal to a reference load, and is greater than a voltage level corresponding to the maximum grayscale value when the load of the image data is greater than the reference load.

* * * * *